US009328637B2

(12) United States Patent
Weber et al.

(10) Patent No.: US 9,328,637 B2
(45) Date of Patent: May 3, 2016

(54) CAMSHAFT ADJUSTER

(71) Applicant: Schaeffler Technologies GmbH & Co. KG, Herzogenaurach (DE)

(72) Inventors: Juergen Weber, Erlangen (DE); Dirk Heintzen, Weisendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/430,501

(22) PCT Filed: May 17, 2013

(86) PCT No.: PCT/EP2013/060252

§ 371 (c)(1),
(2) Date: Mar. 23, 2015

(87) PCT Pub. No.: WO2014/048587

PCT Pub. Date: Apr. 3, 2014

(65) Prior Publication Data

US 2015/0211390 A1 Jul. 30, 2015

(30) Foreign Application Priority Data

Sep. 26, 2012 (DE) ..... 10 2012 217 394

(51) Int. Cl.
*F01L 1/34* (2006.01)
*F01L 1/344* (2006.01)

(52) U.S. Cl.
CPC ..... *F01L 1/3442* (2013.01); *F01L 2001/34479* (2013.01); *F01L 2001/34483* (2013.01)

(58) Field of Classification Search
CPC ..... F01L 2001/34423; F01L 2001/34479; F01L 2001/34486; F01L 2001/34483; F01L 2001/3445; F01L 2001/3443; F01L 2001/34433; F01L 2001/34426; F01L 2001/34446; F01L 1/3442; Y10T 137/8667
See application file for complete search history.

(56) References Cited

U.S. PATENT DOCUMENTS 6,367,438 B2 * 4/2002 Neller ..... F01L 1/3442 123/90.15
2012/0204822 A1 * 8/2012 Weber ..... F01L 1/3442 123/56.2

FOREIGN PATENT DOCUMENTS

DE 100 24 760 12/2001
GB 2 472 054 1/2011

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A camshaft adjuster having a pot-like stator drivable by a crankshaft of an internal combustion engine; and a rotor rotationally fixedly connected to a camshaft of the internal combustion engine; having an outer ring and an inner ring arranged concentrically with respect to the outer ring; and radially oriented webs connecting the outer ring and the inner ring to each other, which subdivide the annular space formed between the outer ring and the inner ring into working chambers, wherein the working chambers are subdivided into oppositely acting pressure chambers by stator webs connected to the stator and projecting laterally into the working chambers; and the rotor is mounted by the outer ring in the radial direction on a cylindrical wall of the pot-like stator, wherein at least one depression forming a pocket to receive hydraulic oil is provided on the radial outer side of the outer ring and/or on the radial inner side of the cylindrical wall of the pot-like stator.

7 Claims, 2 Drawing Sheets

CAMSHAFT ADJUSTER

The present invention relates to a camshaft adjuster.

BACKGROUND

In their basic configuration, camshaft adjusters generally include a stator which is drivable by a crankshaft of an internal combustion engine and a rotor which is rotatably fixedly connected to the camshaft of the internal combustion engine. An annular space is provided between the stator and the rotor, which is divided into a plurality of working chambers by projections which are rotatably fixedly connected to the stator and project radially to the inside, the working chambers each being divided into two pressure chambers by a vane which projects radially outward from the rotor. Depending on the application of a pressure medium to the pressure chambers, the rotor is adjusted with respect to the stator, and the camshaft is thus also adjusted with respect to the crankshaft, in the "advance" or "retard" direction. The stator and the inwardly projecting projections may be formed, for example, as a single piece from a cup-shaped sintered part, which, however, has the disadvantage that the base surface of the stator acting as the sliding surface must undergo a complex remilling process. A minimum radius in the transitions from the base surface to the projections is unavoidable. As a result of this radius, a slight inner leakage is unavoidable. Furthermore, a slight clearance on the radial bearing between the radial front sides of the projections and the hub of the rotor is unavoidable, due to manufacturing, since the rotor counter-contour may be manufactured only with large tolerances and tool and manufacturing complexity.

A camshaft adjuster is already known from DE 100 24 760 A1, in which the rotor is designed in the manner of a wheel rim having an outer ring and an inner ring, which are connected to each other via webs. The webs divide the annular space between the outer ring and the inner ring into working chambers and assume the function of the vanes known from the prior art. The projections of the stator project laterally into the working chambers and divide each working chamber into two pressure chambers in the known way. The working chambers are delimited both radially inwardly and radially outwardly by walls of the rotor, in the circumferential direction by the webs and laterally by the wall of the stator and the wall of the cover closing the stator.

Due to the proposed shape of the rotor, the sealing surface which was previously provided on the radial outside of the vanes is eliminated, since the vanes no longer rest with their front sides directly against the inner wall of the stator cup and seal the pressure chambers. The previously provided radial bearing of the rotor, formed by the radially inwardly projecting projections of the stator, is furthermore eliminated and replaced by the circular ring-shaped bearing surface of the outer ring of the rotor, which rests against the inner wall of the stator.

SUMMARY OF THE INVENTION

It is an object of the present invention to provide a camshaft adjuster which includes a rotor having an inner ring and an outer ring connected to each other via webs and which is intended to have a further improved support.

The present invention provides that at least one indentation forming a pocket is provided on the radial outside of the outer ring and/or on the radial inside of the cup-shaped stator for the purpose of accommodating hydraulic oil. The advantage of the provided approach may be seen in that a cavity is formed by the indentation or the pocket, in which a residual quantity of hydraulic oil may always be accommodated even when the rotor is at a standstill with respect to the stator. The radial bearing between the outer ring of the rotor and the inner wall of the stator is thus immediately lubricated with hydraulic oil when the rotary motion of the rotor with respect to the stator sets in, in that the hydraulic oil is drawn by the rotary motion from the pocket into the bearing gap between the rotor and the stator. Since with each pressure application to the pressure chambers with the aid of hydraulic oil, a residual amount of hydraulic oil always also flows into the pockets and does not flow out again, a residual quantity of hydraulic oil is always present in the pockets at the beginning of the rotary motion or while the rotor is at a standstill, it being possible to use this residual quantity for a rotary motion of the rotor which subsequently sets in, for the purpose of improved lubrication of the radial bearing. This is particularly advantageous during a cold start of the internal combustion engine, when the pressure chambers are not yet completely filled with hydraulic oil, and no hydraulic oil enters the radial gap between the rotor and the stator from the pressure chambers.

It is furthermore proposed that the indentation on the outer ring of the rotor is provided in the area of the webs. The rotor has a greater material thickness in the connecting sections of the webs and the outer ring, so that the indentation may be introduced herein without thereby substantially reducing the load capacity of the rotor. The greater material thickness may furthermore be used to situate an indentation of appropriate size.

It is also proposed that the indentation is situated on the outer ring of the rotor, and a through-opening emptying into one of the pressure chambers is provided in the outer ring of the rotor and situated adjacent to the indentation. By situating the indentation in the outer rotor and situating the through-opening adjacent thereto, a particularly good lubrication of the rotor and a filling of the pockets with hydraulic oil may be achieved independently of the angular position of the rotor.

In this case, it is furthermore proposed that the rotor is rotated with respect to the stator in one rotating direction when pressure is applied to the pressure chamber, and the through-opening emptying into the pressurized pressure chamber is situated offset with respect to the indentation by an angle counter to the rotating direction. Due to the proposed arrangement of the through-opening, it is ensured that the hydraulic oil is always drawn into the bearing gap of the radial bearing between the outer ring and the inner wall of the stator when the rotary motion of the rotor sets in. If the rotor is subsequently rotated with respect to the stator in the opposite rotating direction, the hydraulic oil is removed from the previously pressurized pressure chamber and forced into the pockets through the through-opening. The pockets are regularly filled with hydraulic oil thereby, the filling of the pockets with hydraulic oil being facilitated by the arrangement of the indentations, offset by an angle counter to the rotating direction with respect to the through-openings, which empty into the pressure chambers to which hydraulic oil was previously applied. It is advantageous that the through-openings are situated adjacent to the indentations, so that the hydraulic oil flows into the indentations on a very short path to be covered.

It is furthermore proposed that the through-opening emptying into the pressure chamber is situated coaxially to a pressure medium channel provided in the inner ring. The advantage of this arrangement may be seen in that the through-opening and the pressure medium channel may thereby be manufactured together, in that both are drilled radially from the outside in a single operation.

It is furthermore proposed that multiple indentations are provided, which are situated equidistantly from each other in the circumferential direction. Due to the proposed design, the support is further improved in that hydraulic oil is introduced into the radial bearing at multiple, evenly situated points.

The rotor may be manufactured particularly cost-effectively by forming it from a part which is manufactured as a single piece. The single-piece part may be designed, for example, as a sintered part and reworked after manufacturing on the surfaces important for operation, including, for example, the side surfaces, the bearing surfaces on the outer ring, the inner surface of the inner ring, the sealing surfaces of the pressure chambers and the bore for the locking pin of the center locking mechanism.

BRIEF DESCRIPTION OF THE DRAWINGS

The present invention is explained in greater detail below on the basis of one preferred exemplary embodiment.

DETAILED DESCRIPTION

Figure 1:
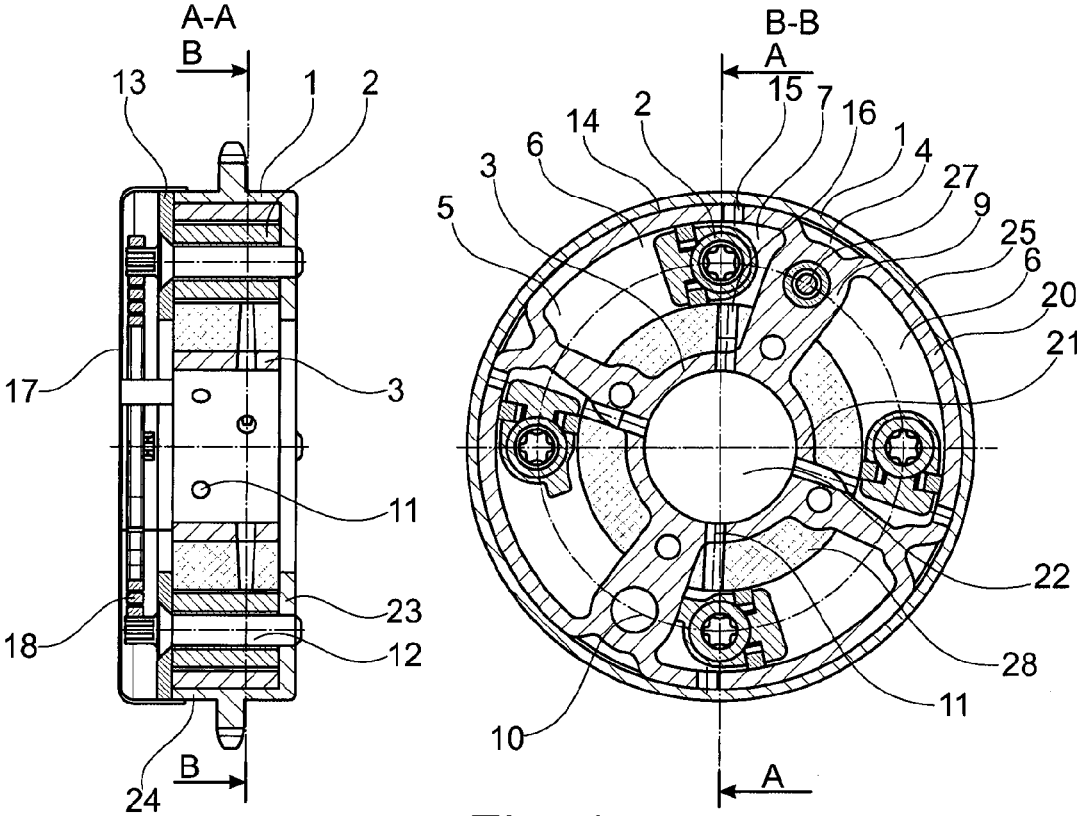
FIG. 1 shows different sectional views of a camshaft adjuster.
Figure 2:
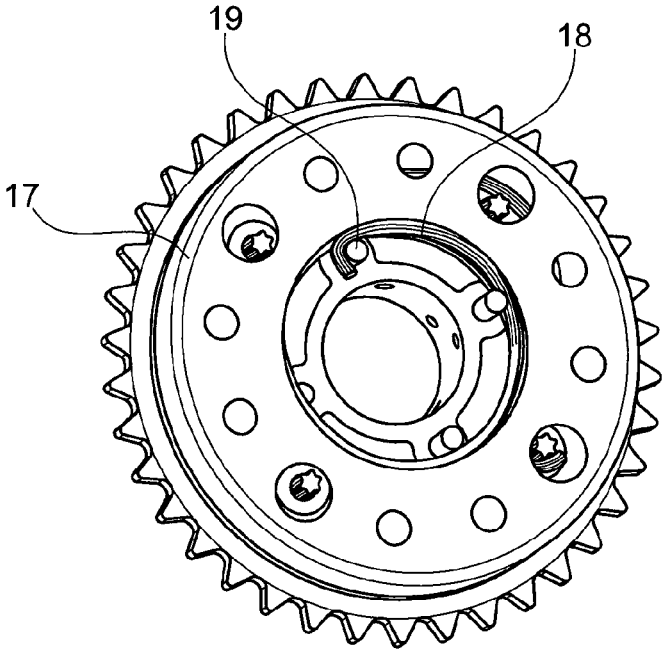
FIG. 2 shows a view of the cover side of the camshaft adjuster.
Figure 3:
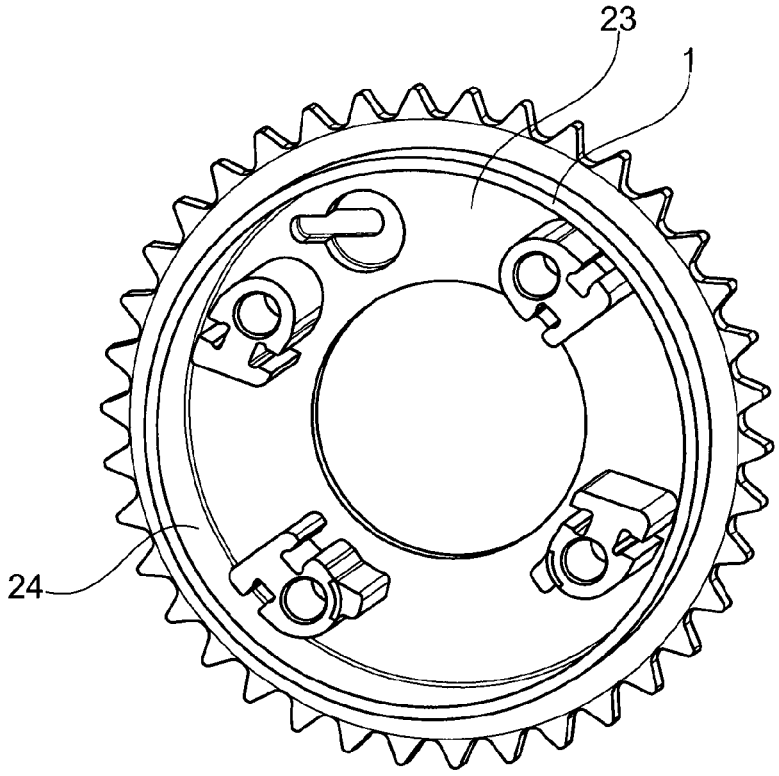
FIG. 3 shows a stator of the camshaft adjuster.
Figure 4:
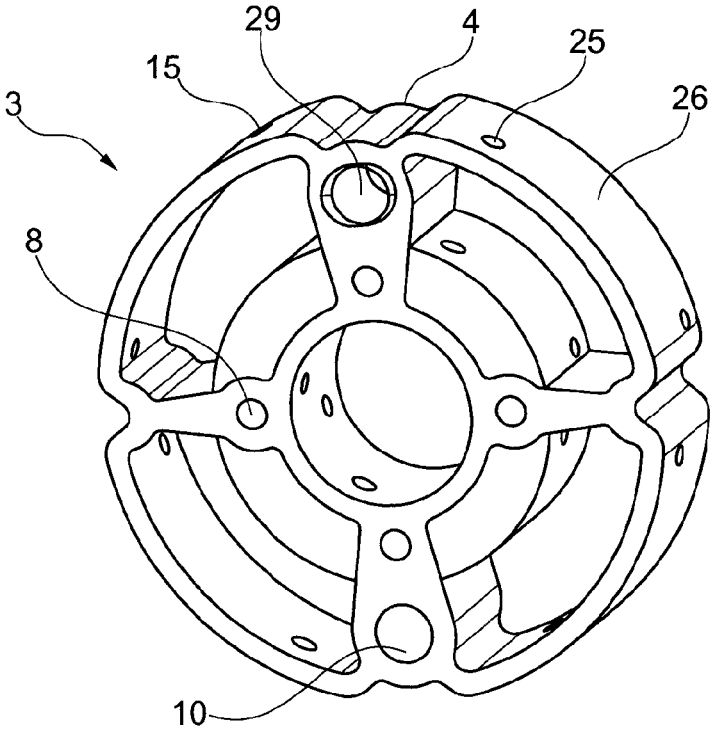
FIG. 4 shows a rotor of the camshaft adjuster.

A camshaft adjuster according to the present invention is apparent in the view of sectional directions A-A and B-B in FIG. 1. The camshaft adjuster includes a cup-shaped stator 1, which is shown as an individual part in FIG. 3 and which has a disk-shaped base surface 23, from which an annular section 24 projects axially on the radially outer edge. A radially outwardly projecting toothing is provided on annular section 24, with which, for example, a toothed belt driven by a crankshaft of the internal combustion engine engages. Multiple stator webs 2 are also provided on stator 1, which are screwed to stator 1.

A rotor 3 is situated in stator 1, which is rotatably fixedly connectable to a camshaft of the internal combustion engine and which is designed in the manner of a wheel rim including an outer ring 20, an inner ring 21 and multiple webs 9 connecting outer ring 20 to inner ring 21. Webs 9 divide the annular space between outer ring 20 and inner ring 21 into multiple working chambers 5, which are, in turn, divided into pressure chambers 6 and 7 by stator webs 2 projecting laterally into working chambers 5. A plurality of pressure medium channels 11 are provided in rotor 3, which are part of a higher-level pressure medium circuit and to which hydraulic oil may be applied thereby. Multiple plastic segments 28 are furthermore injection-molded onto inner ring 21, in which pressure medium channels 11 continue in bores 16, which then empty into pressure chambers 6 and 7. The outer diameter of inner ring 21 is enlarged by plastic segments 28, and the volume of pressure chambers 6 and 7 is reduced thereby. The hydraulic oil is supplied in the known manner through a central valve inserted into central opening 22. Cup-shaped stator 1 is braced together with stator webs 2 and a mounted cover 13 via fastening screws 12 to form a rotatably fixed assembly, rotor 3 being dimensioned in width in such a way that it is able to execute rotary motions with respect to stator 1 with the smallest possible axial clearance.

Based on the design of rotor 3 having outer ring 20 and inner ring 21, rotor 3 is supported with the radial outer surface of outer ring 20 on the inner wall of annular section 24 having bearing gap 14 on a significantly larger diameter than was possible in camshaft adjusters of a conventional design. Multiple radially inwardly oriented indentations 4 are provided in outer ring 20, which form pockets in which a residual quantity of hydraulic oil may be accommodated, even when rotor 3 is at a standstill relative to stator 1. Indentations 4 interrupt the radially outer bearing surface of outer ring 20, so that outer ring 20 rests against the inner wall of annular section 24 with four bearing surfaces 26 in the present example. Indentations 4 are preferably provided in the sections of outer ring 20, in which outer ring 20 is connected to webs 9. Since rotor 3 has a very great material thickness in these sections, indentations 4 result in only a slight weakening of rotor 3, or, in other words, rotor 3 is so rigid in these sections that indentations 4 are not pressed together even under higher loads during continuous operation. Through-openings 15 and 25, which each empty into different pressure chambers 6 or 7, are provided adjacent to indentations 4 in outer ring 20. Through-openings 15 and 25 are each offset with respect to adjacent indentations 4 by an angle counter to the rotating direction of rotor 3, the rotating direction of rotor 3 being the rotating direction in which rotor 3 would be rotated with respect to stator 1 when hydraulic oil is applied to pressure chamber 6 or 7, into which particular through-opening 15 or 25 empties.

The situation is explained in greater detail based on through-opening 15. If hydraulic oil is applied to pressure chamber 7, into which through-opening 15 empties, rotor 3 is rotated relative to stator 1, in the clockwise direction in the illustration. Through-opening 15 is shown to be situated with respect to indentation 4 by an angle in the counterclockwise direction. Due to the rotating direction of rotor 3 in the clockwise direction, some of the hydraulic oil is drawn through through-opening 15 into bearing gap 14, so that the radial bearing is supplied with a sufficient quantity of lubricant during the rotary motion of rotor 3. At the same time, the hydraulic oil present in pressure chamber 6 is removed into a reservoir and forced through through-opening 25 into the bearing gap in the rotating direction upstream from indentation 4. The inflow of hydraulic oil from through-opening 25 into indentation 4 is facilitated by the selected arrangement of indentations 4 with respect to through-openings 25 at an angle counter to the rotating direction of rotor 3. During the rotary motion of rotor 3, hydraulic oil is thus introduced into the radial bearing gap from each pocket, and hydraulic oil is introduced into each pocket, independently of the rotating direction of rotor 3.

After the internal combustion engine has been turned off, a residual quantity of hydraulic oil remains in each pocket, which is used to lubricate the radial bearing when the internal combustion engine is restarted. The radial bearing is thus lubricated with hydraulic oil when the internal combustion engine is restarted, even if pressure chambers 6 and 7 are not yet completely filled with hydraulic oil, and no hydraulic oil yet enters the radial bearing through through-openings 15 and 25.

Rotor 3 has a bore 29 for accommodating a locking pin 27 and a bore 10 for compensating for an imbalance. Rotor 3 furthermore has four bores 8 on its inner section, in each of which an axially projecting pin 19 is situated. The end of a torsion spring 18 is suspended on one of pins 19, which rests with the innermost turn on the outside of the other pins 19. Spring 18 is suspended by its other end on one of the screw heads of fastening screws 12 on stator 1, so that they pretension rotor 3 with respect to stator 1 in the direction of an idle position. The camshaft adjuster is covered toward the outside by a cover 17 on the side of spring 18 and cover 13, cover 17 having access openings through which fastening screws 12 are able to engage with the aid of a suitable tool.

LIST OF REFERENCE NUMERALS

1 stator
2 stator web
3 rotor
4 indentation
5 working chamber
6 pressure chamber
7 pressure chamber
8 bore
9 web
10 imbalance bore
11 pressure medium channel
12 fastening screw
13 cover
14 bearing gap
15 through-opening
16 bore
17 cover
18 spring
19 pin
20 outer ring
21 inner ring
22 opening
23 base surface
24 annular section
25 bore
26 bearing surface
27 locking pin
28 plastic segment
29 bore

What is claimed is:

1. A camshaft adjuster comprising:

a cup-shaped stator drivable by a crankshaft of an internal combustion engine;

a rotor rotatably fixedly connectable to a camshaft of the internal combustion engine;

the rotor including an outer ring and an inner ring situated concentrically to the outer ring, and a plurality of radially oriented webs connecting the outer ring and the inner ring to each other and dividing an annular space between the outer ring and the inner ring into multiple working chambers, the working chambers being divided into oppositely acting pressure chambers by stator webs rotatably fixedly connected to the stator and projecting laterally into the working chambers, hydraulic oil being applicable to the pressure chambers, the rotor being supported by the outer ring in the radial direction on a cylindrical wall of the cup-shaped stator, at least one indentation forming a pocket being provided on a radial outside of the outer ring or on the radial inside of the cylindrical wall of the cup-shaped stator for accommodating hydraulic oil.

2. The camshaft adjuster as recited in claim 1 wherein the indentation on the outer ring of the rotor is provided in the area of the webs.

3. The camshaft adjuster as recited in claim 1 wherein the indentation is situated on the outer ring of the rotor, and at least one through-opening emptying into one of the pressure chambers is provided in the outer ring of the rotor and situated adjacent to the indentation.

4. The camshaft adjuster as recited in claim 3 wherein the rotor is rotated with respect to the stator in a rotating direction when pressure is applied to the pressure chamber, and the through-opening emptying into the pressure chamber is situated offset with respect to the indentation by an angle counter to the rotating direction.

5. The camshaft adjuster as recited in claim 3 wherein the through-opening emptying into the pressure chamber is situated coaxially to a pressure medium channel provided on the inner ring.

6. The camshaft adjuster as recited in claim 1 wherein the at least one indentation includes multiple indentations situated equidistantly from each other in the circumferential direction.

7. The camshaft adjuster as recited in claim 1 wherein the rotor is formed from a part manufactured as a single piece.

* * * * *